US006366020B1

(12) United States Patent
Gu et al.

(10) Patent No.: US 6,366,020 B1
(45) Date of Patent: Apr. 2, 2002

(54) UNIVERSAL OPERATING DC CERAMIC METAL HALIDE LAMP

(75) Inventors: Hongyon Gu, Lexington; Jakob Maya, Brookline, both of MA (US)

(73) Assignee: Matsushita Electric Works R & D Laboratories Inc., Woburn, MA (US)

( * ) Notice: Subject to any disclaimer, the term of this patent is extended or adjusted under 35 U.S.C. 154(b) by 0 days.

(21) Appl. No.: 09/382,408

(22) Filed: Aug. 24, 1999

(51) Int. Cl.[7] ..... H01J 61/30
(52) U.S. Cl. ..... 313/634; 313/635; 313/613
(58) Field of Search ..... 313/25, 492, 613, 313/614, 616, 635, 238, 346 R, 355, 356

(56) References Cited

U.S. PATENT DOCUMENTS 4,281,274 A 7/1981 Bechard et al.
4,651,048 A * 3/1987 Liebe ..... 313/25
4,910,432 A 3/1990 Brown et al.
4,935,668 A 6/1990 Hansler et al.
5,144,201 A 9/1992 Graham et al.
5,291,100 A 3/1994 Wood

* cited by examiner

*Primary Examiner*—Vip Patel

(57) ABSTRACT

A discharge lamp adapted to operate on DC current and being equivalent to an AC-operated ceramic metal halide lamp in different operating positions. The lamp comprises a ceramic arc tube with a fill of mercury, rare gas and metal halides. The arc tube is sealed with an anode and a cathode and has at least one metal heat shield on the cathode side of the ceramic DC metal halide arc tube to achieve operation of the lamp with universal orientation. Each of the two electrodes sealed into the arc tube are different, the anode being formed of tungsten with a ball shaped tip and the cathode being formed of a thoriated tungsten rod and a wound coil of the rod.

10 Claims, 4 Drawing Sheets

UNIVERSAL OPERATING DC CERAMIC METAL HALIDE LAMP

BACKGROUND OF THE INVENTION

This invention relates to high intensity discharge lamps and, more particularly, to a DC metal halide lamp comprising a ceramic discharge vessel. In the ceramic discharge vessel, a cathode and an anode are arranged, a discharge space is provided, metal halide and mercury fillings are contained, and a metal heat shield is especially added on the cathode side for maintaining equivalent cold spot temperature in different lamp operating positions.

Most DC metal halide lamps on the market are short arc types such as disclosed in U.S. Pat. Nos. 5,291,100 and 5,144,201 for applications such as projection, vehicle headlamp, fiber optics illuminations, etc. Until now, the majority of metal halide lamps for general lighting have been operated on AC power sources. Due to the constant demand for cost cutting of electronic ballast and the continuous effort on improving efficacy of lighting systems, low wattage DC metal halide lamps fabricated with quartz envelopes for applications in general lighting have been on the market for some time as disclosed in U.S. Pat. No. 4,281,274.

However, the existing DC quartz metal halide lamps on the market are restricted to vertical operation (±45°). When a DC quartz metal halide lamp, particularly with a formed arc tube, is operated in the horizontal position, the degree of upwards arc bulge increases significantly and creates an unfavorable local hot spot resulting in a significant CCT shift and ultimately shorter lamp life.

It is an objective of the present invention to provide a universal operating DC ceramic metal halide lamp for general lighting applications. With this invention, DC ceramic metal halide lamps utilizing a metal heat shield on cathode side are suitable for universal operation. The DC ceramic metal halide lamp also exhibits relatively better performance over its AC counterpart. Moreover, a full bridge inverter is eliminated in DC electronic ballast so that about 25% component cost reduction for electronic ballast is readily achieved.

DESCRIPTION OF RELATED PRIOR ART

There are disadvantages included in the existing AC metal halide discharge lamps and ballast systems:

(a) AC metal halide lamps, such as disclosed in U.S. Pat. Nos. 4,910,432 and 4,935,668 and European patent 0,587,238A1 including quartz and ceramic discharge vessels have identical electrodes that are compromised during both positive and negative cycles. DC metal halide lamps have a unique anode and cathode design that is optimized for operation. This leads to a higher initial efficacy for DC Lamps when compared to AC Lamps with similar color rendering index (CRI) and comparable correlated color temperature (CCT). (see FIG. 4).

(b) There is high re-ignition voltage during initial warm-up and steady state operation if the lamp operates on the traditional magnetic ballast. A ratio of re-ignition voltage to lamp voltage greater than two leads to lamp extinguishing during operation on a conventional lamp supply.

(c) AC electronic ballasts require a full bridge inverter. This not only adds about 25% component cost, but also makes the circuit more complicated compared to the DC electronic ballast.

There are drawbacks in existing DC metal halide discharge lamps with quartz discharge vessel:

(a) The DC quartz lamp for general lighting applications is restricted to vertical operation only. Moreover, the anode has to be located at bottom during operation for performance optimization. If the cathode is located at bottom, a color separation in the arc stream can be visually observed which results from separation of different emitters in the plasma. From a practical point of view, an arc tube has to be mounted differently inside the outer jacket for base up and base down applications. Although the DC quartz lamp exhibits a higher efficacy and a comparable lumen maintenance over AC quartz lamp in vertical operating position, the DC quartz lamp loses the advantage of universal operating which is common for AC lamp.

(b) It is well known by those familiar with the art that IR reflective coating is required for AC quartz metal halide lamps. In DC quartz metal halide lamps, the anode is placed at the bottom for vertical operation. Because the tip temperature of the anode is higher than that of the cathode during operation, the cold spot temperature of the DC quartz lamp is high enough for desirable performance without IR reflective coating on the end bell. The light emitted from the DC arc tube is no longer partially blocked by the IR coating. This also increases the throughput of the DC quartz lamps.

(c) Most commercially available quartz metal halide arc tubes contain sodium iodide as one of their fill ingredients. Sodium can migrate through the quartz wall. The loss of sodium atoms from NaI frees iodine that can then combine with the mercury in the arc tube to form $HgI_2$ which leads to hard starting and a change in color of the lamp. One way to prevent Na loss while the arc is operated on a d.c. power source is to connect a glass sleeve to a point of potential which is positive with respect to the arc tube. In this way, the glass sleeve prevents sodium loss from the arc by trapping ultraviolet light and by shielding the arc from photoelectrons as disclosed in U.S. Pat. No. 4,281,274. However, electrical bias on the glass sleeve brings complexity to the mount structure and ballast circuit design. In contrast to the situation with quartz, migration of sodium through an alumina arc tube wall is negligible. Elimination of Na depletion mechanism in the ceramic,arc tube leads to a smaller initial color spread and a better color stability over lifetime for the DC ceramic lamp.

(d) The anode seal area may exceed the temperature limitations of the molybdenum foil/quartz seal for an equivalent AC electrode length. The temperature of the molybdenum foil to quartz seal of the anode press seal area is expected to be much hotter than the temperature of press seal area with AC electrode which has equivalent length as the anode. With appropriate anode design, the anode seal temperature can be reduced to be suitable for quartz-molybdenum seal. However, it is limited to relatively low current operation so that DC quartz lamp is only suitable for low wattage in general lighting applications.

(e) Due to dimensional non-symmetry of anode and cathode, for lamp wattage of 100 W or higher, different pinch seal setup and process for anode and cathode seal is necessary to ensure the quality of the seal. This adds cost to lamp manufacturing.

SUMMARY OF THE INVENTION

A primary objective of the present invention is to provide a ceramic DC lamp which overcomes the disadvantages of a quartz DC lamp.

Another objective of the present invention is to provide a DC lamp which maintains the attributes of low wattage AC lamps (such as universal operation) and yet overcomes the disadvantages of AC operation.

Yet another objective of the present invention is to provide a low wattage metal halide lamp that can be operated with an DC electronic ballast, resulting in substantial system cost reduction.

Still another objective of the present invention is to provide the design features of DC ceramic metal halide lamp for universal burning operation and different correlated color temperature as well as different chemistries.

The objectives are achieved according to the invention by providing a discharge lamp with a ceramic arc tube, preferably with a bulge shape but not limited to one particular shape. There are two electrodes sealed into the arc tube, one tungsten anode with a ball shaped tip and one thoriated tungsten cathode with rod and wound coil. The arc tube is filled with a certain amount of rare gas, mercury, and rare earth chemistry.

Due to the cooling effect of the emitted electrons, the cold spot temperature while the lamp operated with the cathode at the bottom is lower than that with the anode at the bottom. In order to compensate for the reduction of cold spot temperature, a molybdenum or niobium foil heat shield is secured to the cathode side of the arc tube. In this way, the infrared radiation is reflected back to the arc tube and the heat loss at the end of the main arc tube body on the cathode side is reduced significantly. The arc tube maintains equivalent cold spot temperatures in different lamp operating positions.

This invention offers many advantages over all AC metal halide lamp/ballast systems and DC quartz metal halide lamp/ballast systems.

(a) The DC ceramic metal halide lamp has a unique ball shaped anode and coil wound rod cathode. Both electrodes are optimized for direct current operation. The overall lamp performance is demonstrated to be relatively better than AC ceramic lamps.

(b) A metal shield is specifically added on the cathode side to preserve the heat. The metal heat shield minimizes the cold spot temperature variations due to operational position changes. Without the metal shield, the DC ceramic lamp exhibits significant color temperature variation for different operating positions.

(c) DC ceramic lamps with a metal heat shield on the cathode side meet all the universal operating criteria. However, the metal heat shield is not limited to the cathode end only. For various anode design and seal arrangements, a metal tube can be added on the capillary of the anode side for universal burning applications.

(d) Migration of sodium through the alumina arc tube wall is negligible. Alumina hardly dissolves in tungsten so that the reactions of the rare-earth elements with alumina are self-limiting. Therefore, there is minimal depletion of the metallic part of the fill. Reduction of the depletion mechanisms for both Na and other metallic parts guarantees a stable halide composition and thus a small initial color spread and very good color stability over lifetime in the ceramic arc tube.

(e) The ceramic metal halide lamp is much more compact than the quartz lamp. The arc length of DC ceramic lamp is shorter than that of the DC quartz lamp. There is no visual color separation observed when the lamp is operated with cathode at the bottom. The visual color separation in the arc stream can be easily observed for the quartz DC lamp when it operates with the cathode at the bottom.

(f) The metal heat shield covering the cold-spot area of a discharge vessel will block only a small amount of emitted visible light since the area is behind the electrode. However, the overall efficacy of the DC ceramic lamp with heat shield is higher than the equivalent AC ceramic lamp.

DETAILED DESCRIPTION OF THE REFERRED EMBODIMENTS

Figure 1:
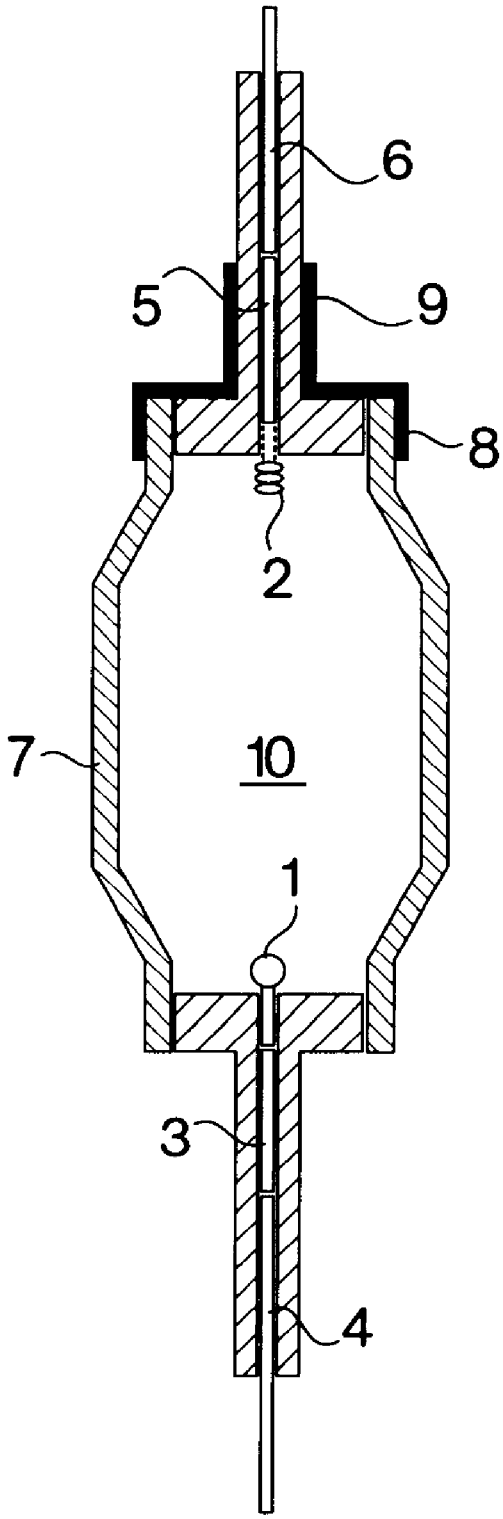
FIG. 1 is a side elevational view in cross section of an arc tube according to the present invention.

It is an objective of the present invention to provide a high-pressure discharge metal halide lamp with a ceramic vessel operated on a DC electronic ballast. The lamp can be operated universally and performs better than its AC counterpart. The discharge vessel, as shown in FIG. 1, comprises a tungsten anode with a ball shaped tip 1 and a thoriated tungsten cathode with rod and wound coil 2. The diameter of anode rod is 0.50–0.65 mm. The diameter of the tungsten ball tip is 0.95–1.10 mm. The length of the tungsten anode is 3.0–3.5 mm. The tungsten anode is welded to a halide resistant metal wire 3 with diameter of 0.55–0.70 mm. The other end of the metal wire is then welded to a niobium wire 4 with diameter of 0.95–1.15 mm. The diameter of the cathode rod is 0.33–0.38 mm. The diameter of the cathode tip portion is 0.75–0.85 mm. The length of the thoriated tungsten cathode is 3.0–3.5 mm. The thoriated tungsten cathode is welded to a halide resistant metal wire 5 with diameter of 0.35–0.40 mm. The other end of the metal wire is then welded to a niobium wire 6 with diameter of 0.90–95 mm. The ceramic discharge vessel, i.e., arc tube, has a bulged shape 7. The bulged shape is preferable but the invention is not limited to one particular shape. The center diameter of the vessel is 11.5–12.5 mm. The smaller diameter of the vessel is 6.0–6.8 mm. The length of each smaller cylinder section is about 25–30% of the large cylinder section. The outside diameters of the capillary are 3.0–3.4 mm and 3.4–3.8 mm for cathode and anode side, respectively. The wall thickness of the vessel is 1.0–1.1 mm. The vessel is filled with a rare gas range of 100–140 torr, mercury of 6.0–6.8 mg, and rare earth chemistry of 5.0–6.5 mg.

Figure 2:
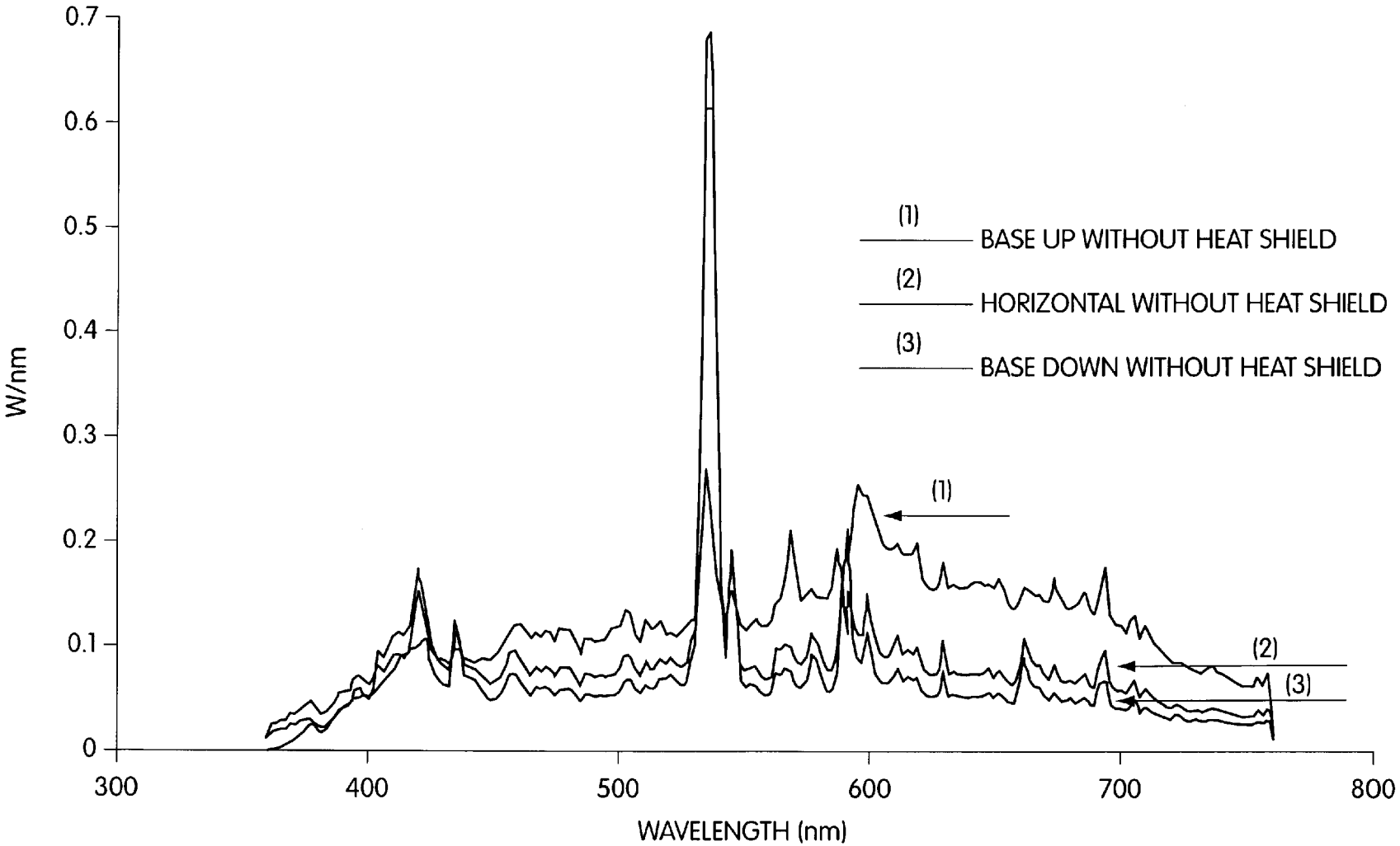
FIG. 2 shows the spectral output of the ceramic DC lamp without a metal shield for different operating positions.

Due to the cooling effect of the emitted electrons, the cold spot temperature while the lamp operated with the cathode at the bottom is lower than that with the anode at the bottom. In order to compensate for the reduction of cold spot temperature, a metal foil cup heat shield 8 and a metal heat shield tube 9 is secured to the cathode side of the arc tube. In this way, the infrared radiation is reflected back to the arc tube and the heat loss at the end of the main arc tube body on the cathode end is reduced significantly. The heat shield material can be molybdenum, nickel, niobium, Kovar, and other metals that are suitable for utilization in relative high temperature region. The metal sheet or foil has a thickness preferably from 0.1 mm to 0.5 mm. The end surface of the arc tube can be partially or fully covered by the heat shield. The length of the heat shield covering the circumference of the smaller cylindrical section is preferably from 0.5 to 3.0 mm. The heat shield can be kept in place by a molybdenum wire or a niobium starting wire holding at both ends of the vessel. As shown in FIG. 2, there is a significant reduction of continuum radiation across the entire visible range for DC ceramic lamps without a metal shield added to the cathode end in the base down and horizontal operating positions. Moreover, there is a strong line radiation at 535.05 nm that makes the lamp look greenish. This is attributed to the cold spot change when the lamp is operated either with the cathode at the bottom or horizontally, compared to the lamp operated with the anode at the bottom.

Figure 3:
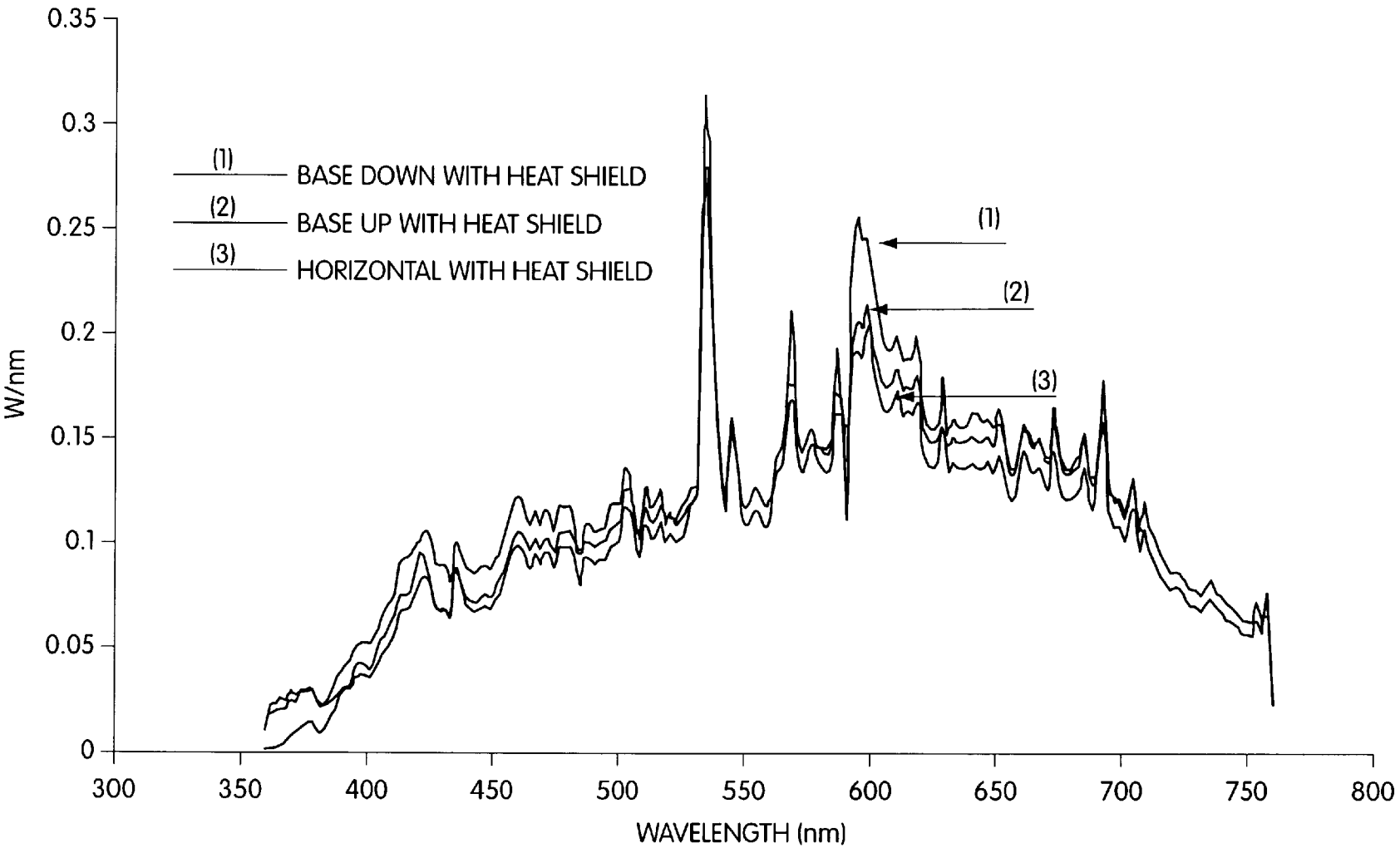
FIG. 3 shows the spectral output of the ceramic DC lamp with a metal shield for different operating positions.

For a ceramic arc tube with a metal heat shield added on the cathode end, the correlated color temperature variation between base up, base down, horizontal, and 45° operation is within 250K. This is within normal variation of AC ceramic lamps operated in different orientations. As shown in FIG. 3, the spectra of DC ceramic metal halide lamps for different operating positions, with added metal heat shield on the cathode end of arc tube, very closely track together. This reveals that the lamp has acceptable performance variation for different operating positions.

Moreover, a bulged arc tube shape is preferable. For this particular shape, the minimum amount of light emitted from the arc tube is blocked by the metal shield with better heat preservation. The efficacy of the DC ceramic metal halide lamp fabricated with bulged arc tube is about 8% higher than that of the AC ceramic lamp fabricated with the same shape arc tube.

The second objective of the present invention is to bring more than a 25% component and manufacturing cost saving to the electronic ballast. A full bridge inverter can be eliminated in the DC electronic ballast. Combining the elimination of the bridge circuit, the simplified electronic ballast design and manufacturing, a 25% or more cost reduction for electronic ballast is achievable.

In order to make a meaningful comparison between the performance of the AC and DC ceramic lamps we have used the identical chemistry in both. This rare earth chemistry gives good color rendering and efficacy. In Table 1 we list the performance of the AC and DC ceramic lamps for base up (BU), base down (BD), and horizontal operation (HOR) at 100 hours. As can be seen from the table, the universal operation of the AC lamp is maintained in the DC lamp. In addition, the performance in some cases exceeds the AC lamp. Prior life test results on quartz lamps have already indicated to us unequivocally that the life expectancy of the DC lamp is superior to the AC lamp. The reasons for that have already briefly been explained above. Again, the lack of reignition (and thereby sputtering), the non-compromised electrode design which is optimized for ion and electron collection are factors contributing to the superior performance.

Figure 4:
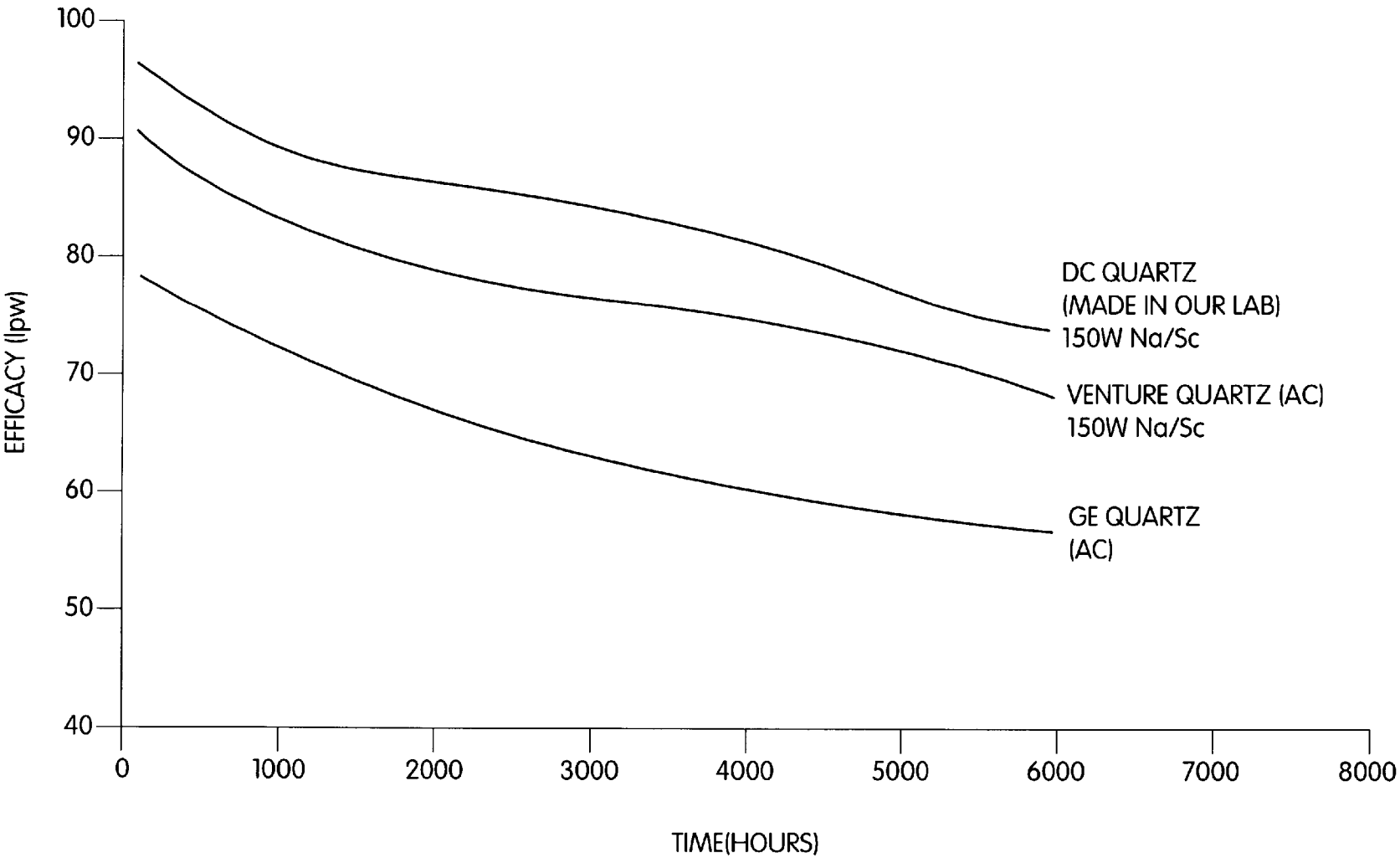
FIG. 4 shows maintenance of quartz DC lamps designed in our laboratory and compared to commercially available AC lamps.

In FIG. 4 we show the maintenance of DC quartz lamps designed in our laboratory and the maintenance of General Electric's and Venture Lighting's 150 W quartz metal halide lamps. This test had 12 lamps each and was aged on a 10-hour on and 2-hour off cycle. All testing was performed with virgin lamps aged on electronic ballasts. As can be seen from the Figure the 150 W DC quartz lamps show superior efficacy and equivalent maintenance when compared with commercially available AC quartz lamps. All these lamps were filled with Na/Sc chemistry.

TABLE 1

Comparison of AC and DC Ceramic Lamps At Various Operating Positions at 100 Hours.

| 100 hrs. | | BU | BD | HOR |
|---|---|---|---|---|
| AC | ϵ (LPW) | 82.0 | 83 | 85 |
| AC | CCT (K) | 4291 | 4198 | 4036 |
| AC | CRI | 94 | 93 | 95 |
| DC | ϵ (LPW) | 84.9 | 89.6 | 86.2 |
| DC | CCT (K) | 4004 | 3897 | 4019 |
| DC | CRI | 95 | 96 | 94 |

ϵ is the luminous efficacy in units of lumen per watt BU defines operating in the base up position BD defines operating in the base down position HOR defines operating in the horizontal position While we have shown and described what are at present considered to be the preferred embodiments of the invention, it will be apparent to those skilled in the art that various modifications can be made herein without departing from the scope of the invention as defined by the appended claims.

We claim:

1. A discharge lamp adapted to operate on DC current, said lamp comprising a ceramic arc tube having a fill of mercury, rare gas, and metal halides, said arc tube being sealed with an anode and a cathode in capillaries and forming an envelope, said envelope having a metal heat shield and a metal foil tube, said shield being in the form of a cup which is placed on an end of cathode side of the DC metal halide arc tube, the height of the heat shield cup being adjusted in accordance with the cathode arrangement and metal halide fill composition within the arc tube said metal foil tube surrounding the top of the capillary on the anode side said foil cup and foil tube serving as heat shields for the discharge lamp to preserve the heat for the cathode end to boost the cold spot temperature to an operable region when the lamp is not operated with anode at bottom, said heat shield arrangement providing a cold spot temperature variation of the DC ceramic metal halide lamp equivalent to a AC ceramic metal halide lamp for different operating positions to achieve operation of said lamp with universal orientation.

2. The lamp according to claim 1 wherein the shapes of the two electrodes sealed into the arc tube are different, the anode being formed of tungsten with a ball-shaped tip and the cathode being formed of a thoriated tungsten rod and a wound coil of tungsten on said rod.

3. The lamp according to claim 1 wherein foil members connect to the outside of said arc tube, said foil member being selected from the group consisting of molybdenum, nickel, niobium, Kovar, tantalum and those materials that can survive in a high temperature environment.

4. The lamp according to claim 1 wherein heat shields are disposed on both the anode and cathode sides of said arc tube various anode design and arrangements.

5. The lamp according to claim 3 further including a metal tube surrounding the capillary of the anode side for universal operating applications.

6. The lamp according to claim 1 wherein the arc tube has a bulged shape.

7. The lamp according to claim 1 further including a DC electronic ballast to operate said lamp.

8. A discharge lamp adapted to operate on DC current, said lamp comprising a ceramic, cylindrical arc tube having a fill of mercury, rare gas, and metal halides, said arc tube being sealed with an anode and a cathode and forming an envelope, said envelope having at least one metal heat shield on the cathode side of the ceramic DC metal halide arc tube, said shield being in the form of a cup adequately placed on the end of cathode side of the arc tube, the height of the heat shield cup being adjusted in accordance with the cathode arrangement and metal halide fill composition within the arc tube, said heat shield further including a metal foil tube surrounding the top portion of the ceramic capillary section, both foil cup and foil tube serving as heat shields for the discharge lamp to preserve the heat for the cathode end to boost the cold spot temperature to an operable region when the lamp is not operated with anode at bottom, said heat shield arrangement providing a cold spot temperature variation of the DC ceramic metal halide lamp equivalent to the AC ceramic metal halide lamp for different operating positions to achieve operation of said lamp with universal orientation.

9. The lamp according to claim 8 wherein the shapes of the two electrodes sealed into the arc tube are different, the anode being formed of tungsten with a ball-shaped tip and the cathode being formed of a thoriated tungsten rod and a wound coil of tungsten on said rod.

10. The lamp according to claim 8 wherein the shapes of the ceramic arc tubes are cylindrical, ellipcoudal, spherical or a combination resulting in a bulgy shape in the middle portion of the cylinder.

* * * * *